United States Patent [19]

Limehouse et al.

[11] 4,442,765

[45] Apr. 17, 1984

[54] DEVICE FOR PREPARING A BUNCH OF PRODUCE FOR SHIPMENT, DISPLAY AND SALE

[76] Inventors: William L. Limehouse, 1468 S. Edgewater Dr., Charleston, S.C. 29407; Thomas A. Miller, P.O. Box 602, Hastings, Fla. 32045

[21] Appl. No.: 365,151

[22] Filed: Apr. 5, 1982

[51] Int. Cl.[3] ..... B65B 13/02

[52] U.S. Cl. ..... 100/6; 53/390; 53/556; 53/585; 100/9

[58] Field of Search ..... 100/2, 6, 9; 53/390, 53/515, 414, 556, 585; 99/637, 635

[56] References Cited

U.S. PATENT DOCUMENTS

| | | | |
|---|---|---|---|
| 164,091 | 6/1875 | Ireland | 100/6 |
| 2,179,897 | 11/1939 | Oelkers | 99/635 |
| 2,514,038 | 7/1950 | Doolittle | 53/390 X |
| 3,186,333 | 6/1965 | Hoffman et al. | 100/9 |
| 3,320,989 | 5/1967 | Verardo | 100/6 X |
| 3,386,371 | 6/1968 | Farmer et al. | 100/9 |
| 3,974,762 | 8/1976 | Kita | 100/9 |

*Primary Examiner*—Billy J. Wilhite

*Attorney, Agent, or Firm*—Julian W. Dority

[57] ABSTRACT

A device for preparing a bunch of produce for shipment, display and sale by placing a rubber band on the produce and cutting the stalks of said bunch of produce to a predetermined length. The device includes an upper plate member, a lower plate member, and a vertically movable intermediate plate member. Centrally located stalk receiving holes are provided in the plate members of sufficient diameter for receiving a stalk portion of a bunch of produce. A plurality of movable pins are carried by the intermediate plate member and extend vertically through respective holes of the upper plate member for receiving a stretched rubber band. Upon depressing a foot pedal, the rubber band is released around the stalk portion of a bunch of produce. A cutting assembly which has a horizontally adjustable positioning block is used for severing the stalk portion of the bunch of produce to a predetermined length.

6 Claims, 4 Drawing Figures

DEVICE FOR PREPARING A BUNCH OF PRODUCE FOR SHIPMENT, DISPLAY AND SALE

BACKGROUND OF THE INVENTION

When produce such as collards, asparagus, spinach, brocolli, etc. is harvested from the field, they are normally cut by hand in bunches or stalks which must be packaged and cut to predetermined lengths prior to being shipped, displayed and sold in grocery stores.

Heretofore, these bunches of produce were picked off a grading conveyor by personnnel and tied into bunches by means of inserting a rubber band over the stalk portion and then cut with a knife to a predetermined length. The manually placing of the rubber band on the produce is time-consuming and the cutting of the stalks to a predetermined length is usually done by visually judging the length of the bunch of produce. When this is done by skilled workers, normally the bunches of produce are cut to substantially the same length. However, the accuracy of the lengths of produce varies with the degree of experience and skill of the person making such cuts.

Attempts have been made to provide devices which will enable cellophane to be placed around the head portion of produce and a rubber band inserted around the stalk portion and when cellophane is used, around the cellophane to secure the bunch of produce in a package. One such device is disclosed in U.S. Pat. No. 3,974,762 wherein the head portion of the bunch of produce is inserted within a receptacle and by depressing the head portion of the produce against a movable bottom, a rubber band is released around the stalk of the bunch of produce. The problem using the head portion to depress the bottom is that the pressure required for depressing the head portion will bruise the produce.

A similar device for inserting rubber bands around articles is disclosed in U.S. Pat. No. 2,514,038.

Mechanisms for sizing bunches of produce are disclosed in U.S. Pat. Nos. 164,091; 2,179,897; 3,186,333; 3,320,989; and 3,386,371. Some of these devices are complicated and normally require additional handling of the produce between the banding and sizing operation.

SUMMARY OF THE INVENTION

A device for preparing a bunch of produce for shipping, display and sale by placing a rubber band on said produce and cutting the stalks of said produce to a predetermined length. The device includes a vertically extending frame member which has an upper plate member carried thereon. Positioned below the upper plate member on the frame is a lower plate member. A vertically movable intermediate plate member is carried between the upper and lower plate members. Centrally located stalk receiving holes are provided in the plate members and are of sufficient diameter for receiving the stalk portion of the bunch of produce. A plurality of holes are concentrically located in the upper plate member about the stalk receiving hole through which a plurality of pins that are carried by the intermediate plate member extend. Springs are carried on the pins between the intermediate plate member and the lower plate member for urging the intermediate plate member to a raised position wherein the pins extend above the upper plate member for receiving a stretched rubber band therearound. Linkages extend between the intermediate plate member and a foot operated lever so that upon depressing the foot-operated lever, the intermediate plate member is lowered, retracting the pins below the upper plate member for releasing the rubber band about a stalk portion of a bunch of produce that is inserted through the centrally located receiving hole. A stalk cutting assembly is carried by the frame member and includes a horizontally adjustable positioning block with an arcuate channel-shaped member spaced therefrom. A pivotal knife is carried by the channel-shaped member for cutting the stalks of a bunch of produce to a predetermined length, determined by the position of the adjustable positioning block relative to the arcuate channel member.

The bunches of vegatables are normally picked off a grading conveyor and the stalk portion thereof is inserted through the holes of the plate members. The foot pedal is depressed, placing the rubber band thereon. While still holding the bunch of vegetables, it is moved to the cutting assembly with the head portion of the bunch being positioned adjacent the adjusting block and the stalk portion being inserted in the arcuate-shaped member so that upon manipulating the knife, the stalk is cut to a predetermined length and is ready for sale.

Accordingly, it is an important object of the present invention to provide a device for preparing a bunch of produce for display and sale by placing a rubber band thereon and cutting the stalks to predetermined lengths.

Still another important object of the present invention is to provide an apparatus for cutting bunches of produce to a predetermined length and placing a rubber band on the stalk portion of the bunch while only handling the bunch of produce one time.

Still another important object of the present invention is to provide a simple and efficient apparatus for preparing produce for display and sale.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DETAILED DESCRIPTION

Figure 1:
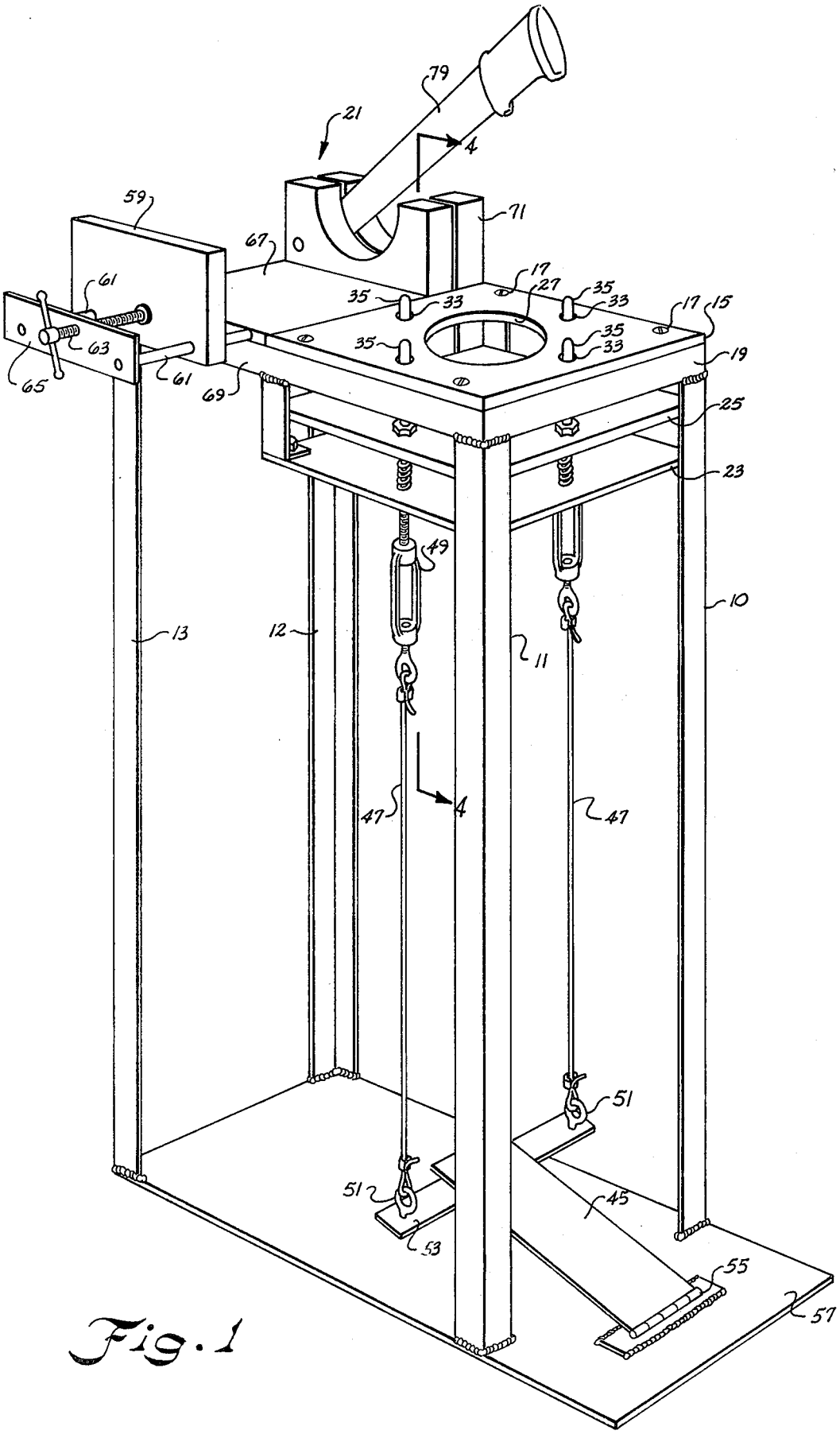
FIG. 1 is a perspective view of a device for preparing bunches of produce for display and sale constructed in accordance with the present invention.
Figure 2:
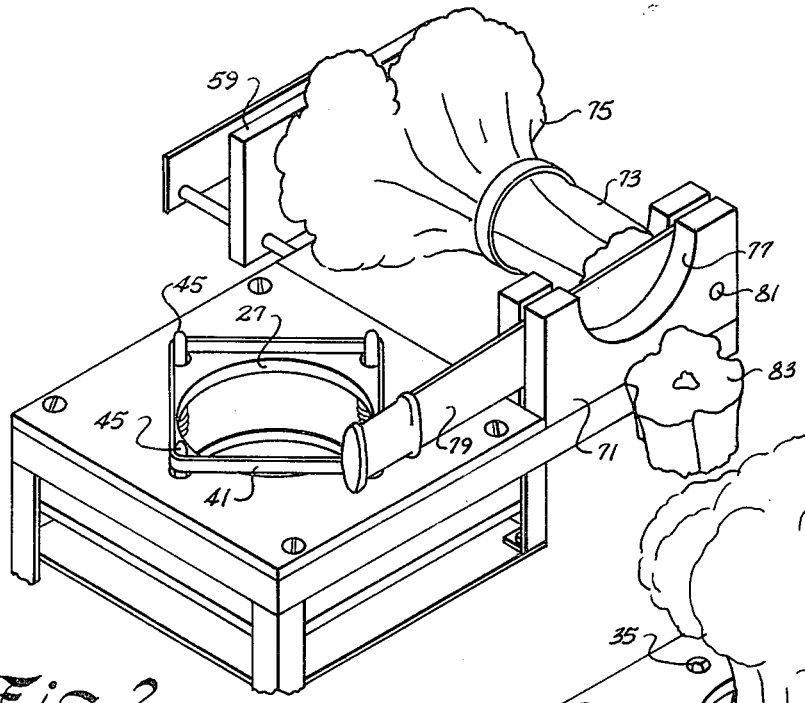
FIG. 2 is an enlarged perspective view illustrating the upper portion of the apparatus of FIG. 1.
Figure 3:
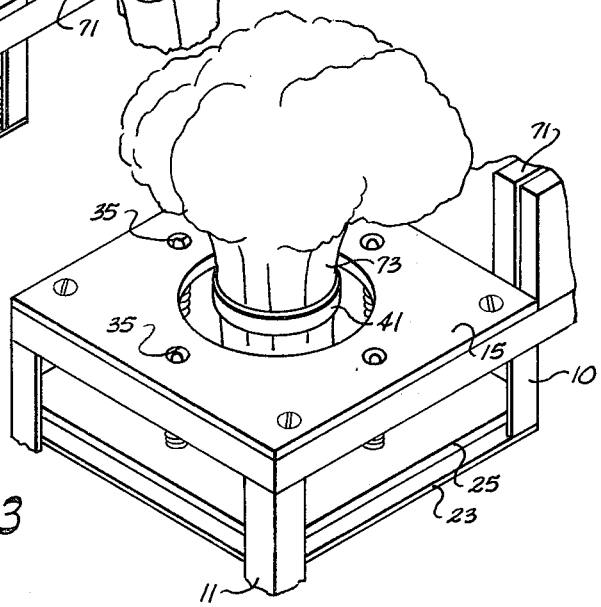
FIG. 3 is an enlarged perspective view showing a rubber band being inserted on the stalk portion of a bunch of produce.

Referring in more detail to FIG. 1 of the drawing, there is illustrated a vertically extending frame which includes four angle irons 10, 11, 12, and 13. Carried on top of the angle irons 10, 11, and 12 and affixed thereto is an upper substantially square shaped plate member 15 that is constructed of plastic material. The upper plate member is secured to the frame member by means of screws 17 which are attached to a horizontally extending channel member 19. The lower portion of the horizontally extending channel members 19 are welded to the upper ends of the angle members 10, 11 and 12. It is noted that the horizontally extending channel members extend laterally beyond the upper plate 15 for supporting a stalk cutting assembly generally designated by the reference character 21. A lower plate member 23 is fixed to the frame members 10, 11 and 12 by any suitable means such as bolts. A vertically movable intermediate plate member 25 is carried between the upper plate member 15 and the lower plate member 23. The plate members 15, 23 and 25 are constructed of any suitable self-lubricating material such as ultra-high molecular weight polyethylene. The intermediate plate member is square in shape so that the corners thereof mate with the corners of the frame members 10, 11, and 12 providing a guide therefor as it is moved up and down during the banding operation.

Centrally located stalk receiving holes 27, 29, and 31 are provided in the upper, intermediate, and lower plate members 15, 25 and 23, respectively. The diameters of the holes 27, 29 and 31 are sufficient so that the stalk portion of a bunch of produce can be inserted therethrough.

Figure 4:
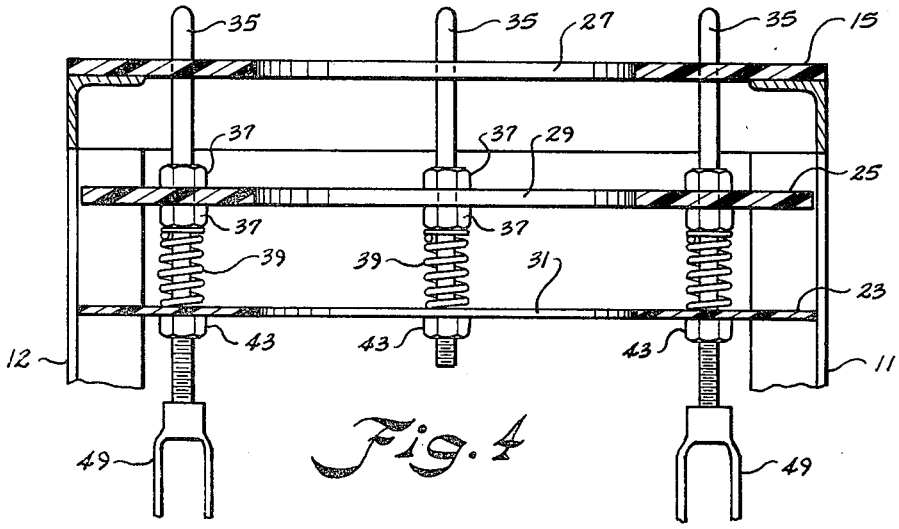
FIG. 4 is a sectional view showing retractable pins used for holding a stretched rubber band and releasing same around the stalk portion of a bunch of produce.

A plurality of holes 33 are concentrically located in the upper plate member 15 about the stalk-receiving hole 27. A plurality of vertically extending pins 35 are carried by the intermediate plate member and extend vertically through a respective hole provided in the upper plate member 15. The pins 35 have a threaded portion extending from about the center thereof downwardly upon which nuts 37 are positioned for securing the pins to the intermediate plate member 25. Springs 39 are carried on the pins below the nut 37 so as to force the intermediate member to an upper position such as shown in FIG. 4 wherein the pins 35 project above the upper surface of the upper plate for receiving a stretched rubber band 41. A nut 43 is carried on the threaded portion of the pin member below the lower plate 23 for limiting the upper movement of the intermediate plate 25.

A depressible foot pedal 45 is connected to the lower end of the pin by means of a flexible cable 47 and a turn buckle 49. The lower ends of the cables 47 are connected by means of I bolts 51 to outwardly extending arms 53 that are suitably attached to the pivotal pedal 45. It is noted that the lower end of the pedal 45 is connected by means of a hinge 55 to a base supporting plate 57.

The stalk cutting assembly 21 includes a horizontally adjustable positioning block 59 that slides on a pair of spaced bars 61. The horizontal position of the block 59 can be varied by rotating the screw 63 which is threaded in a fixed plate 65 carried on the ends of the rods 61. The other ends of the rods 61 are supported on a base plate 67 that is, in turn, carried on horizontal flange members 69 to which the upper plate member 15 is carried.

An arcuate channel-shaped member 71 is carried on the opposite end of the base plate 67 for receiving the stalk portion 73 of a bunch of produce 75. The stalk portion 73 rests within the arcuate cut-out 77 which includes a pair of split members. A knife blade 79 is pivoted about pin 81 so that it can be raised to an upright position for inserting the stalk portion of the bunch of produce 75 therein. After the head of the stalk has been positioned against the positioning block 59, the knife 79 is lowered to the horizontal position, severing the end portion 83 from the stalk.

As the bunches of produce move along a grading conveyor, they are normally in the condition that they were in upon being cut in the fields and they will have stalks of varying lengths. Before the produce can be shipped to grocery stores for display and sale, they must be banded with a rubber band and sized to a predetermined length. A person standing next to the conveyor grabs the bunch of produce and adjusts the heads thereof to the approximate same position. He then inserts the stalk portion of the produce through the centrally located holes in the plate members. The foot pedal 45 is then depressed, releasing the rubber band 41 from the pins 45. This causes the band to be placed around the stalk portion of the bunch of produce. He then inserts the end of the bunch of produce in the arcuate-shaped member 77 with the head portion abutting against the adjustable positioning block 59. He then pulls the knife 79 down and severs the end off of the bunch of produce.

While a preferred embodiment of the invention has been described using specific terms, such description is for illustrative purposes only, and it is to be understood that changes and variations may be made without departing from the spirit or scope of the following claims.

What is claimed is:

1. A device for placing a rubber band around the stalk portions of a bunch of produce having uneven stalk lengths and relatively evenly positioned head comprising:

a vertically extending frame member;

an upper plate member carried on said vertically extending frame member and being fixed thereto;

a lower plate member carried by said frame member vertically spaced below said upper plate member, said lower plate member being fixed to said frame member;

a vertically movable intermediate plate member carried between said upper and lower plate members;

centrally located stalk receiving holes provided in said plate members of sufficient diameter for a stalk portion of said bunch of produce to be inserted therethrough;

a plurality of holes located in said upper plate member concentrically about said stalk receiving hole;

a plurality of pins carried by said intermediate plate member, each extending vertically through a respective hole of said plurality of holes provided in said upper plate member;

resilient means forcing said intermediate plate member to a raised position wherein said plurality of pins project above said upper plate member for receiving a stretched rubber band therearound, and means for depressing said intermediate plate member retracting said pins below said upper plate member for releasing said rubber band about the stalk portion of said bunch of produce that is inserted through said centrally located stalk receiving hole.

2. The device as set forth in claim 1 further comprising:

said means for depressing said intermediate plate member including, (i) a foot-operated pedal;

(ii) linkage extending from said foot operated pedal to said intermediate plate member so that upon depressing said foot operated pedal, said intermediate plate member is depressed releasing said rubber band about the stalk portion of said bunch of produce.

3. The device as set forth in claim 1 further comprising:

a spring carried on at least some of said pins between said lower plate member and said intermediate member tending to force said intermediate member to said raised position wherein said pins project above said upper plate member.

4. The device as set forth in claim 1 further comprising:

a stalk cutting assembly carried by said frame member including, (i) a horizontally adjustable positioning block;

(ii) an arcuate channel-shaped member horizontally spaced from said positioning block for holding the stalk portion of said bunch of produce for cutting, and (iii) a pivotal knife blade carried by said channel-shaped member for cutting said stalks of said bunch of produce to a predetermined length.

5. The device as set forth in claim 4 further comprising:

screw means connected to said positioning block for varying the spacing between said positioning block and said arcuate channel-shaped member for cutting said bunch of produce to predetermined lengths.

6. A device for preparing a bunch of produce for display and sale by placing a rubber band on said produce and cutting the stalks of said bunch of produce to a predetermined length, comprising:

a vertically extending frame member, an upper plate member carried on said vertically extending frame member and being fixed thereto;

a lower plate member carried by said frame member vertically spaced below said upper plate member, said lower plate member being fixed to said frame member;

a vertically movable intermediate plate member carried between said upper and lower plate members, centrally located stalk receiving holes located in said plate members of sufficient diameter for a stalk portion of said bunch of produce to be inserted therethrough;

a plurality of holes located in said upper plate member concentrically about said stalk receiving hole;

a plurality of pins carried by said intermediate plate member, each extending vertically through a respective hole of said plurality of holes provided in said upper plate member;

said intermediate plate member being constructed of ultra-high molecular polyethylene;

resilient means forcing said intermediate plate member to a raised position wherein said plurality of pins project above said upper plate member for receiving a stretched rubber band therearound, a foot operated pedal, linkage means extending from said foot-operated pedal to said intermediate plate member so that upon depressing said foot operated pedal, said intermediate plate member is depressed releasing said stretched rubber band about the stalk portion of said bunch of produce;

a stalk cutting assembly carried by said frame member including, (i) a horizontally adjustable positioning block, (ii) an arcuate channel-shaped member horizontally spaced from said positioning block for holding the stalk portion of said bunch of produce for cutting, and a pivotal knife blade carried by said channel-shaped member for cutting said stalk of said bunch of produce to a predetermined length measured from the head portion of said bunch of produce;

whereby a bunch of produce can be secured together by means of a rubber band and cut to a predetermined length for shipment, display and sale.

* * * * *